US006830419B1

(12) United States Patent
Turner et al.

(10) Patent No.: US 6,830,419 B1
(45) Date of Patent: Dec. 14, 2004

(54) AEROSOL CAN ENDS

(75) Inventors: Stephen B. Turner, Centerville, OH (US); Carl W. Hoying, Springboro, OH (US)

(73) Assignee: Alfons Haar Inc., Miamisburg, OH (US)

( * ) Notice: Subject to any disclaimer, the term of this patent is extended or adjusted under 35 U.S.C. 154(b) by 612 days.

(21) Appl. No.: 09/716,543

(22) Filed: Nov. 20, 2000

(51) Int. Cl.[7] ..... B21D 51/44

(52) U.S. Cl. ..... 413/8; 413/56; 72/329; 72/348; 72/354.8; 72/379.4

(58) Field of Search ..... 72/348, 329, 336, 72/354.8, 379.4, 350, 351; 413/8, 56, 62

(56) References Cited

U.S. PATENT DOCUMENTS

| | | | | |
|---|---|---|---|---|
| 2,763,228 A | | 9/1956 | Lawson | |
| 2,795,350 A | | 6/1957 | Lapin | |
| 4,715,208 A | | 12/1987 | Bulso, Jr. et al. | |
| 4,716,755 A | * | 1/1988 | Bulso et al. | 72/349 |
| 4,808,052 A | | 2/1989 | Bulso, Jr. et al. | |
| 5,046,637 A | * | 9/1991 | Kysh | 220/610 |
| 5,187,966 A | * | 2/1993 | Seconde et al. | 72/329 |
| 5,309,749 A | | 5/1994 | Stodd | |
| 5,381,683 A | * | 1/1995 | Cowling | 72/329 |
| 5,823,040 A | | 10/1998 | Stodd | |

FOREIGN PATENT DOCUMENTS

| | | |
|---|---|---|
| EP | 0 340 955 A1 | 11/1989 |

* cited by examiner

*Primary Examiner*—Allen Ostrager
*Assistant Examiner*—Jimmy T Nguyen
(74) *Attorney, Agent, or Firm*—Stevens & Showalter LLP

(57) ABSTRACT

A dome of a domed aerosol can end is initially formed and then a crown of the can end is formed so that material flow within a workpiece from which the can end is formed is controlled to substantially eliminate wrinkling problems associated with the use of sheet material which is thinner than conventionally used, for example double reduced steel. The peripheral portion of the workpiece is initially clamped between a blank punch and a draw pad, and also between a knockout and a crown ring. An outer first portion of the dome is then formed by an outer redraw sleeve and a dome form die. An inner second portion of the dome is next formed by a dome punch and the dome form die. There may be limited contact of the dome punch with the workpiece during formation of the first portion of the dome and the workpiece may also be clamped between the outer redraw sleeve and the dome form die during formation of the second dome portion. Controlled clamping between the blank punch and the draw pad, between the knockout and the crown ring and between the outer redraw sleeve and the dome form die control material flow for improved formation of the domed aerosol can end with effective elimination of radial wrinkles associated with prior art forming methods and apparatus.

10 Claims, 5 Drawing Sheets

AEROSOL CAN ENDS

BACKGROUND OF THE INVENTION

The present invention relates in general to pressurized containers, commonly referred to as aerosol cans, and, more particularly, to methods and apparatus for forming domed aerosol can ends from thin sheet material.

Ends for closing aerosol cans are well known in the art and are normally made of steel and formed with domes which, for aerosol can bottoms, project inwardly into the cans to withstand the internal pressures necessary for properly dispensing materials packaged within the cans. Conventionally, aerosol can ends are made by blanking a workpiece from a sheet of steel, drawing the workpiece to generate a shallow cup with a crown, and then forming a dome into the cup with an upper dome punch and surrounding redraw sleeve which extend into a lower dome die.

While the conventional forming techniques produce satisfactory aerosol can ends when used on conventional thickness sheet steel, such as single reduced steel, the known techniques often result in radial wrinkles in outer peripheral portions of the domes when used with thinner sheet steel, such as double reduced steel. These wrinkles are not only unsightly but also can result in failures of aerosol cans closed with such ends. Due to these failings, the known techniques have thwarted the canning industry's pursuit of the use of thinner and thinner stock material with regard to making aerosol can ends.

There is, thus, a need for improved methods and apparatus for forming aerosol can ends from thin sheet materials, such as double reduced steel, which overcome the problems currently being encountered in the art. Preferably, the improved methods and apparatus would employ a single acting press having a fixed base and a movable upper punch assembly.

SUMMARY OF THE INVENTION

This need is met by the methods and apparatus of the present invention wherein a dome of a domed aerosol can end is initially formed and then a crown of the can end is formed. In this way, material flow within a workpiece from which the can end is formed is controlled to substantially eliminate wrinkling problems associated with the use of sheet material which is thinner than conventionally used, for example double reduced steel. In particular, the peripheral portion of the workpiece is initially clamped between a blank punch and a draw pad, and also between a knockout and a crown ring. An outer first portion of the dome is then formed by an outer redraw sleeve and a dome form die. An inner second portion of the dome is next formed by a dome punch and the dome form die. There may be limited contact of the dome punch with the workpiece during formation of the first portion of the dome and the workpiece may also be clamped between the outer redraw sleeve and the dome form die during formation of the second dome portion. Controlled clamping between the blank punch and the draw pad, between the knockout and the crown ring and between the outer redraw sleeve and the dome form die control material flow for improved formation of the domed aerosol can end with effective elimination of radial wrinkles associated with prior art forming methods and apparatus.

In accordance with one aspect of the present invention, a method for forming a domed aerosol can end from a sheet of material in a press having a fixed base and a movable punch assembly comprises blanking a workpiece from the sheet of material and holding the workpiece between a blank punch carried by the punch assembly and a draw pad carried by the base. The workpiece is also held between a knockout carried by the punch assembly and a crown ring carried by the base. The blank punch is advanced to form an outer crown lip around the periphery of the workpiece and an outer redraw sleeve carried by the punch assembly is advanced, to form an outer portion of a dome of the domed aerosol can end between the redraw sleeve and a dome form die on the base. The knockout and the crown ring hold the workpiece to control the flow of material into the outer portion of the dome. A dome punch is advanced to form an inner portion of the dome with the dome form die, the knockout and the crown ring holding the workpiece to control the flow of material into the inner portion of the dome. The outer crown lip is shortened in accordance with the flow of material. Finally, the dome form die collapses to form a crown for the domed aerosol can end.

The method for forming a domed aerosol can end may further comprise holding the outer portion of the dome between the redraw sleeve and the dome form die to control the flow of material into the inner portion of the dome as the dome punch advances to form the inner portion of the dome. The steps of advancing an outer redraw sleeve and advancing a dome punch may be performed to substantially completely form the outer portion of the dome before the dome punch contacts the workpiece.

In accordance with another aspect of the present invention, a method of forming a domed aerosol can end from a sheet of material in a press having a fixed base and a movable punch assembly comprises initially forming a dome of the domed aerosol can end, and then forming a crown of the domed aerosol can end. The step of forming a dome of the domed aerosol can end may comprise blanking a workpiece from the sheet of material, holding the workpiece between a blank punch carried by the punch assembly and a draw pad carried by the base and holding the workpiece between a knockout carried by the punch assembly and a crown ring carried by the base. The blank punch and draw pad are advanced to form an outer crown lip around the periphery of the workpiece. An outer redraw sleeve and a dome punch, both carried by the punch assembly, are advanced to form an outer portion of the dome of the domed aerosol can end between the outer redraw sleeve and a dome form die. The dome punch is further advanced to form an inner portion of the dome with the dome form die, the knockout and the crown ring holding the workpiece to control the flow of material into the inner portion of the dome and the outer crown lip shortening in accordance with the flow of material.

The method of forming a domed aerosol can end may further comprise forming a crown of the domed aerosol can end by collapsing the dome form die. The step of forming a dome of the domed aerosol can end may further comprise holding the outer portion of the dome between the outer redraw sleeve and the dome form die to control the flow of material into the inner portion of the dome as the dome punch advances to form the inner portion of the dome.

In accordance with yet another aspect of the present invention, a method for forming a dome of a domed aerosol can end from a workpiece blanked from a sheet of material in a press having a fixed base and a movable punch assembly comprises holding the workpiece between a knockout carried by the punch assembly and a crown ring carried by the base and advancing an outer redraw sleeve and a dome punch, both carried by the punch assembly, to form an outer portion of the dome of the domed aerosol can end between the outer redraw sleeve and a dome form die. The dome punch is further advanced to form an inner portion of the dome with the dome form die, the knockout and the crown ring holding the workpiece to control the flow of material into the inner portion of the dome. The method for forming a dome of a domed aerosol can end may further comprise the step of holding the outer portion of the dome between the outer redraw sleeve and the dome form die to control the flow of material into the inner portion of the dome as the dome punch advances to form the inner portion of the dome.

In accordance with still another aspect of the present invention, apparatus for forming a domed aerosol can end from a sheet of material in a press having a fixed base and a movable punch assembly comprises a blank punch carried by the punch assembly and a crown ring carried by the base, the crown ring being opposite the blank punch for holding a workpiece during formation of the domed aerosol can end. An outer redraw sleeve and a dome punch are carried by the punch assembly with a dome form die mounted on the base. The outer redraw sleeve forms an outer first portion of a dome for the domed aerosol can end with the dome form die prior to the dome punch forming a second inner portion of the dome with the dome form die. In the apparatus for forming a domed aerosol can end the outer redraw sleeve together with the dome form die may hold the workpiece as the dome punch forms the second portion of the dome of the domed aerosol can end. The apparatus may further comprise means for collapsing the dome form die after the dome is formed to form a crown of the domed aerosol can end.

In accordance with an additional aspect of the present invention, apparatus for forming a domed aerosol can end from a sheet of material in a press having a fixed base and a movable punch assembly comprises a blank punch carried by the punch assembly and a crown ring carried by the base, the crown ring being opposite the blank punch for holding a workpiece during formation of the domed aerosol can end. An outer redraw sleeve and a dome punch are carried by the punch assembly while a dome form die is mounted on the base. The outer redraw sleeve forms an outer first portion of a dome for the domed aerosol can end with the dome form die and, together with the dome form die, holds the workpiece as an inner second portion of the dome is formed by the dome punch with the dome form die.

The invention of the present application will be better understood from a review of the following detailed description, the accompanying drawings which form part of the specification and the appended claims.

DETAILED DESCRIPTION OF THE INVENTION

Figure 2:
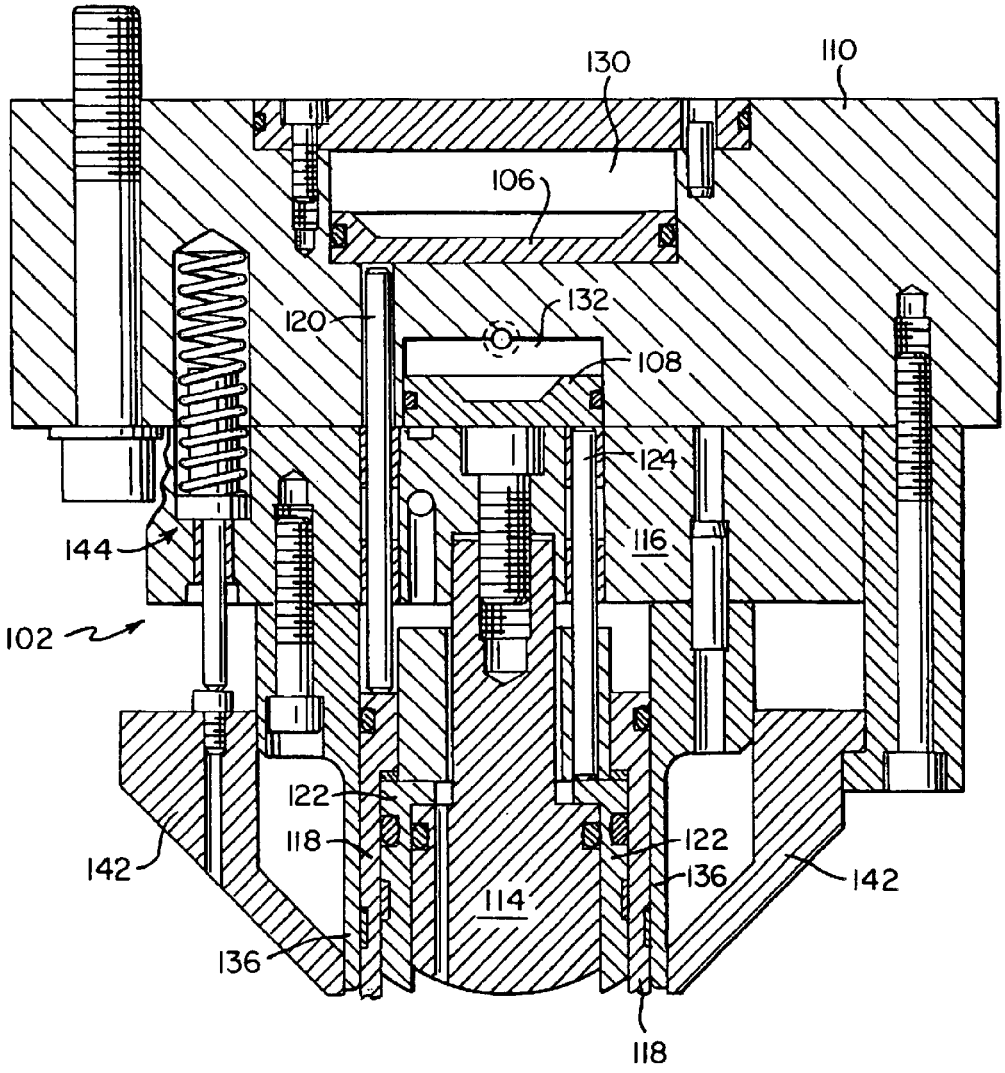
FIG. 2 is a partially sectioned front view of a movable upper punch assembly of the single acting press of FIG. 1.
Figure 3:
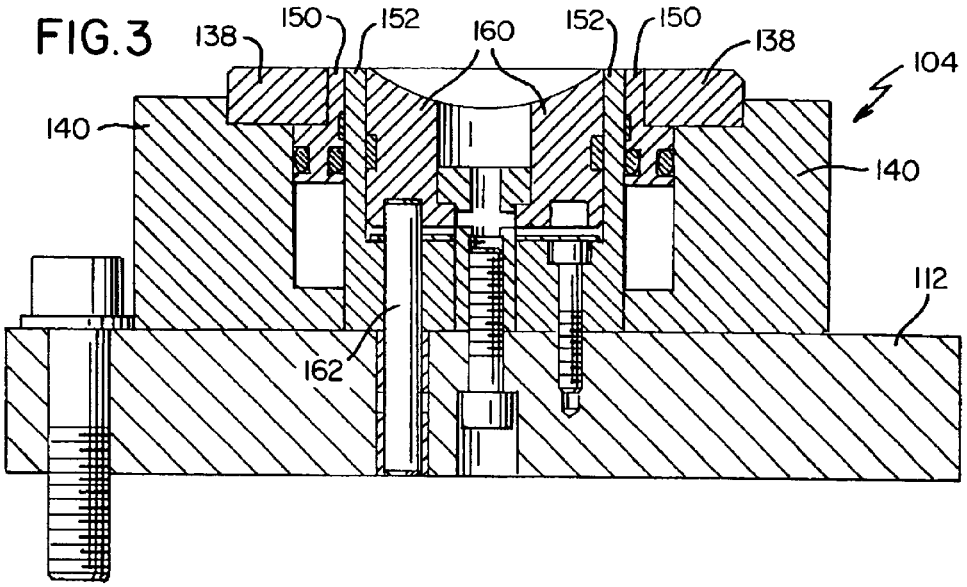
FIG. 3 is a partially sectioned front view of a fixed base of the single acting press of FIG. 1.

For a description of the methods and apparatus of the invention of the present application, reference will now be made to FIG. 1 which illustrates tooling for use in a single acting press 100 having a movable upper punch assembly 102 and a fixed base 104, see FIGS. 2 and 3, respectively. The upper punch assembly 102 includes a knockout piston 106 and a dome punch piston 108 mounted in an upper die shoe 110 while the fixed base 104 includes a lower die shoe 112. A dome punch 114 is secured to an upper retainer 116 of the upper punch assembly 102. A knockout 118 is coupled to the knockout piston 106 by knockout piston pins 120 (only one shown in FIG. 1 and FIG. 2) and an outer dome punch or outer redraw sleeve 122 is coupled to the dome punch piston 108 by outer dome punch pins 124. The bottom surface of the dome punch 114 and the outer redraw sleeve 122 are formed to impart a dome D into a workpiece W, see FIGS. 6 and 7, which is blanked from a sheet of material S.

The invention of the present application is initially being used to form aerosol can ends from double reduced (DR) steel sheet material having a thickness around 0.15 mm; however, the invention is generally applicable for use with a variety of materials including single reduced steel and sheet material having thicknesses less than around 0.15 mm.

Figure 1:
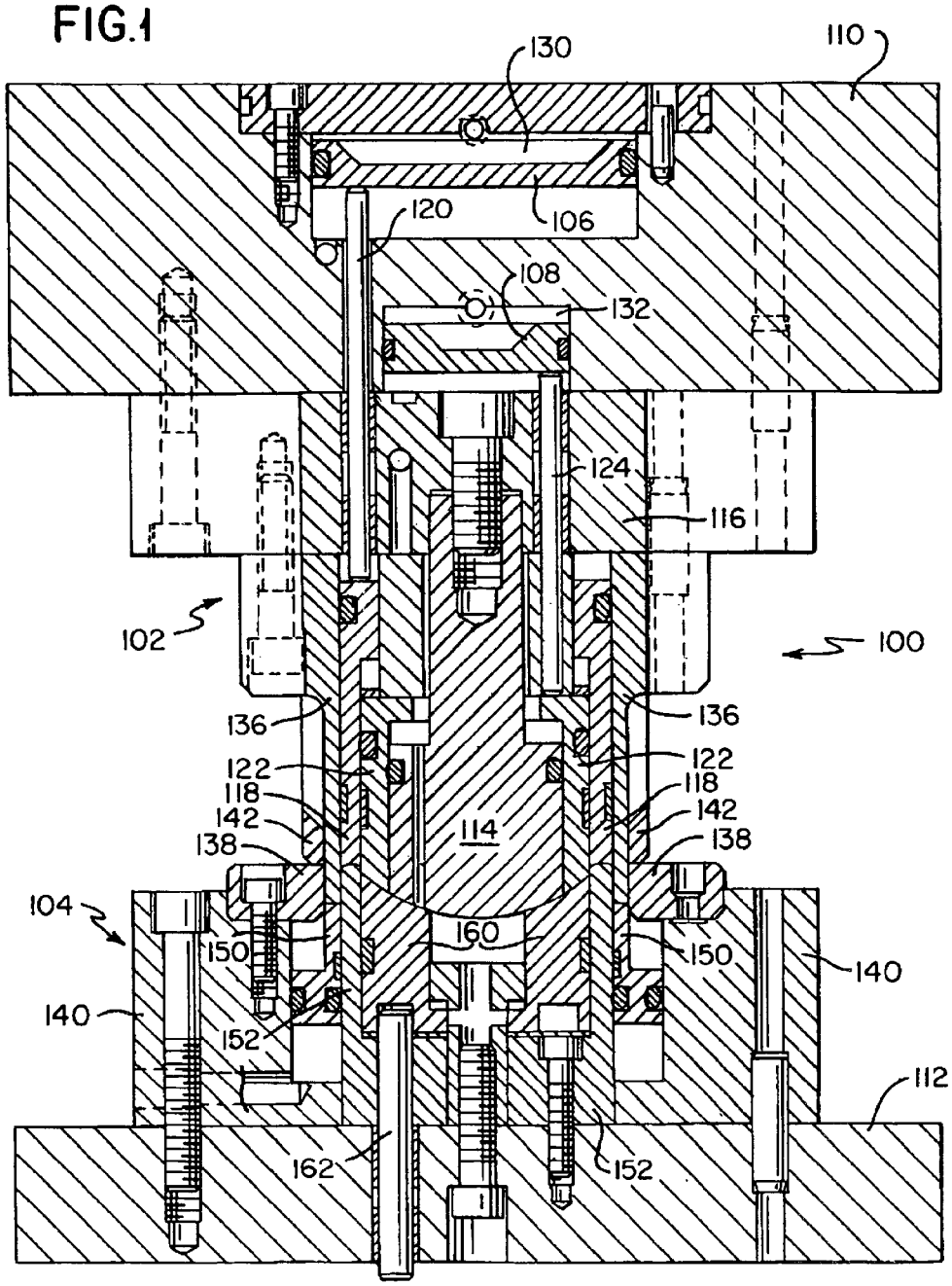
FIG. 1 is a partially sectioned side view of a single acting press including apparatus in accordance with the present invention and being operable in accordance with the present invention to form an aerosol can end with the press being shown at bottom dead center.

In FIG. 1, the press 100 is shown at bottom dead center and the knockout piston 106 and the dome punch piston 108 are shown in their collapsed positions having retracted into the upper punch assembly 102 against pneumatic forces in pressure chambers 130, 132, respectively. As will be apparent to those skilled in the art, the upper punch assembly 102 and the fixed base 104 include a variety of passageways for venting and/or applying compressed air or vacuum within the upper punch assembly 102 and the fixed base 104.

In FIG. 1, a blanking draw die or blank punch 136 enters into an annular cutedge 138 secured to a lower retainer 140 of the fixed base 104 to blank out a workpiece W of metal, see FIGS. 4–7. A stripper ring or stripper 142, which is supported and downwardly biased by a series of spring loaded pressure pin assemblies 144 (only one shown in FIG. 2), holds the sheet of material S against the cutedge 138 for blanking the workpiece W.

An annular draw pad 150, supported in the fixed base 104 by an air cushion, is positioned opposite the blank punch 136 for clamping the workpiece W between the blank punch 136 and the draw pad 150 during initial processing of the workpiece W. An annular crown ring 152 is fixedly secured to the lower die shoe 112 within the lower retainer 140. The upper surface of the crown ring 152 is shaped to contour the crown C, see FIG. 7, of the aerosol can end which is formed from the workpiece W and is positioned opposite the knockout 118. The knockout 118 and crown ring 152 also clamp the workpiece W therebetween during processing of the workpiece W. A dome form die 160 collapses during final processing of the workpiece W against a pneumatic force generated within a lower portion of the press 100 and transferred from the press 100 via pressure pins 162 (only one shown in FIG. 1 and FIG. 3). The dome form die 160 mates with the outer redraw sleeve 122 and a portion of the dome punch 114 to form the dome D of an aerosol can end from the blanked workpiece W.

Figure 4:
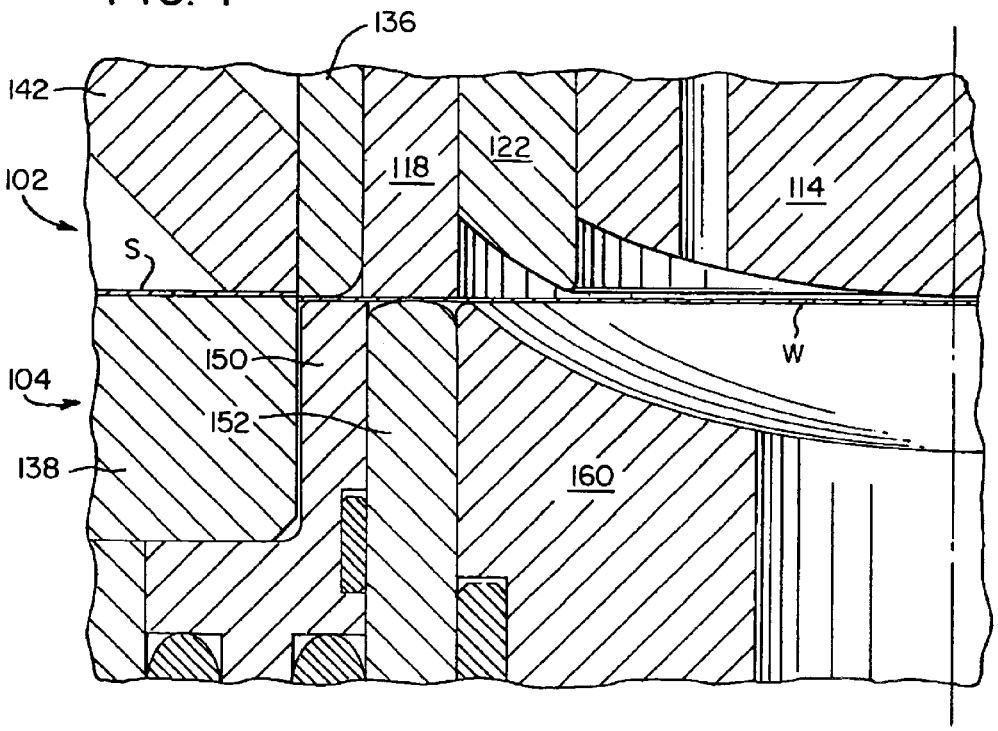
FIG. 4 is an enlarged, partially sectioned front view showing portions of the press of FIG. 1 immediately after blanking with the outer edge of a resulting workpiece clamped between a blank punch and a draw pad, and also clamped between a knockout and a crown ring.

Reference will now be made to FIGS. 4 through 7 which illustrate operation of the apparatus of the invention of the present application in accordance with methods of the invention of the present application. In FIG. 4, the upper punch assembly 102 has traveled downward until the stripper 142 has contacted the sheet of material S and the blank punch 136 has sheared the workpiece W from the sheet of material S. At this point in the operation, the stripper 142 has clamped the sheet of material S against the cutedge 138 and entered a dwell period. The peripheral edge of the workpiece W is clamped between the blank punch 136 and the draw pad 150 which both travel downward along with the outer redraw sleeve 122 and the dome punch 114. The workpiece W is also clamped between the knockout 118 and the fixedly mounted crown ring 152 with the knockout 118 having entered dwell against the pressure in the chamber 130 that is transmitted to the knockout 118 via the pins 120.

Figure 5:
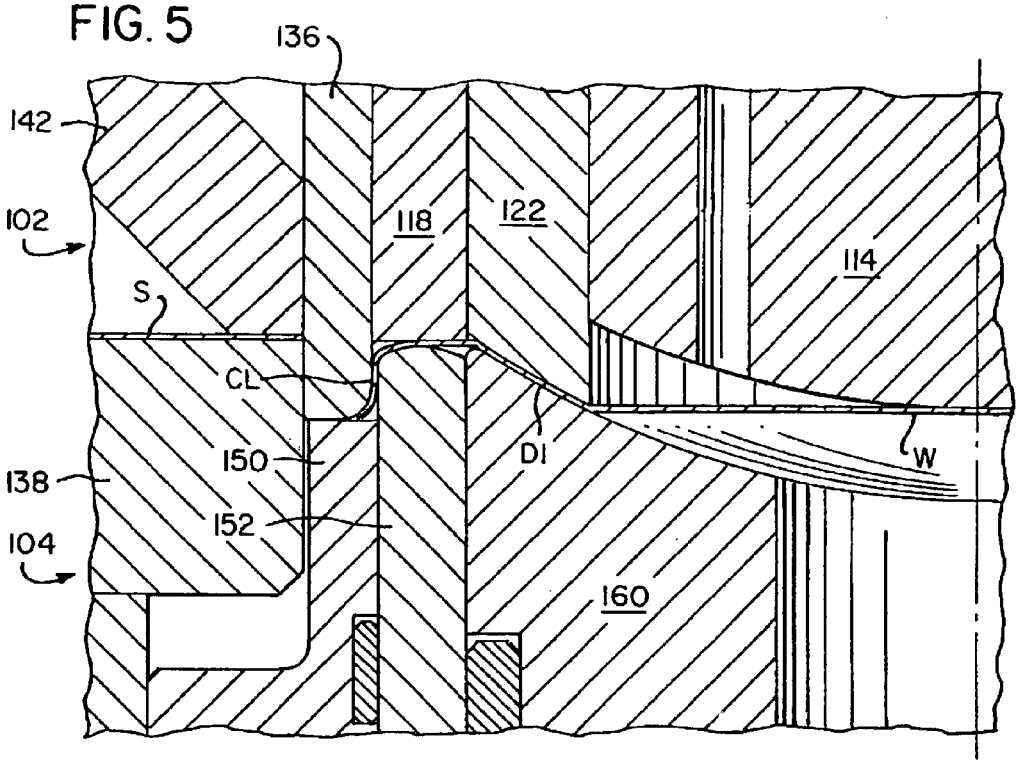
FIG. 5 is an enlarged, partially sectioned front view showing portions of the press of FIG. 1 wherein the blank punch has "wiped" an outer crown lip, the knockout clamping the workpiece against the crown ring to control material flow into a dome of the aerosol can end as an outer portion of the dome is formed between an outer redraw sleeve and a lower dome form die.

In FIG. 5, the blank punch 136 and the draw pad 150 have advanced into the fixed base 104, toward the bottom of the press 100 as illustrated, to form or "wipe" an outer crown lip CL around the periphery of the workpiece W. The outer redraw punch 122 and the dome punch 114, both carried by the upper punch assembly 102, advance relative to the workpiece W to initially form an outer portion D1 of a dome D of the domed aerosol can end between the redraw punch 122 and the dome form die 160. In the illustrated embodiment, the dome punch 114 is just ready to contact the workpiece W as the outer redraw sleeve 122 flows metal from the workpiece W to form the outer portion D1 of the dome D. It is noted, however, that for the present invention the dome punch 114 can contact the workpiece W slightly before the outer redraw sleeve 122 contacts the workpiece W or after the redraw sleeve 122 has formed the outer portion D1 of the dome D.

Figure 6:
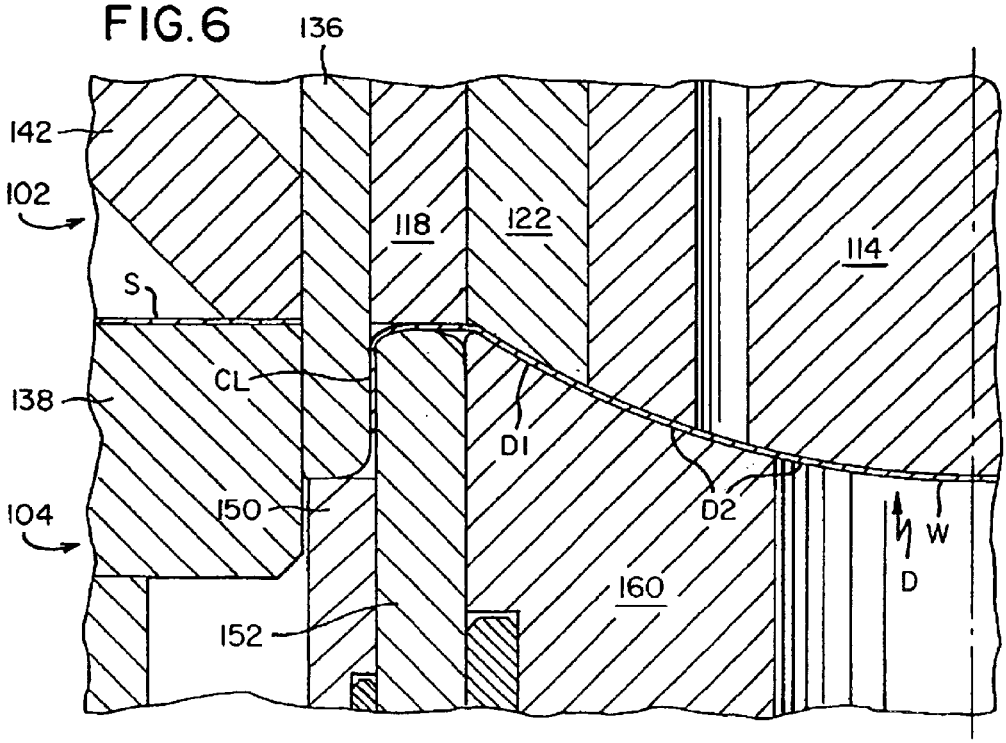
FIG. 6 is an enlarged, partially sectioned front view showing portions of the press of FIG. 1 wherein a dome punch and the lower dome form die complete formation of the dome while the outer redraw sleeve and the lower dome form die together with the knockout and crown ring clamp the workpiece to control material flow.

In FIG. 6, the dome punch 114 advances into the workpiece W to form an inner portion D2 of the dome D with the dome form die 160. The knockout 118 and the crown ring 152 hold the workpiece W to control the flow of material into the inner portion D2 of the dome D and the outer crown lip CL is shortened in accordance with the material flow. To further control the flow of material into the inner portion D2 of the dome D, the workpiece W may also be held at the outer portion D1 of the dome D between the redraw sleeve 122 and the dome form die 160. The holding pressure between the redraw sleeve 122 and the dome form die 160 being controlled by the pressure maintained in the pressure chamber 132, that is applied to the redraw sleeve 122 via the dome punch piston 108 and the dome punch pins 124, and the pressure applied to the pressure pins 162. Sufficient pressure is applied to the pressure pins 162 so that the collapse of the dome form die 160 is prevented during this phase of the operation.

Figure 7:
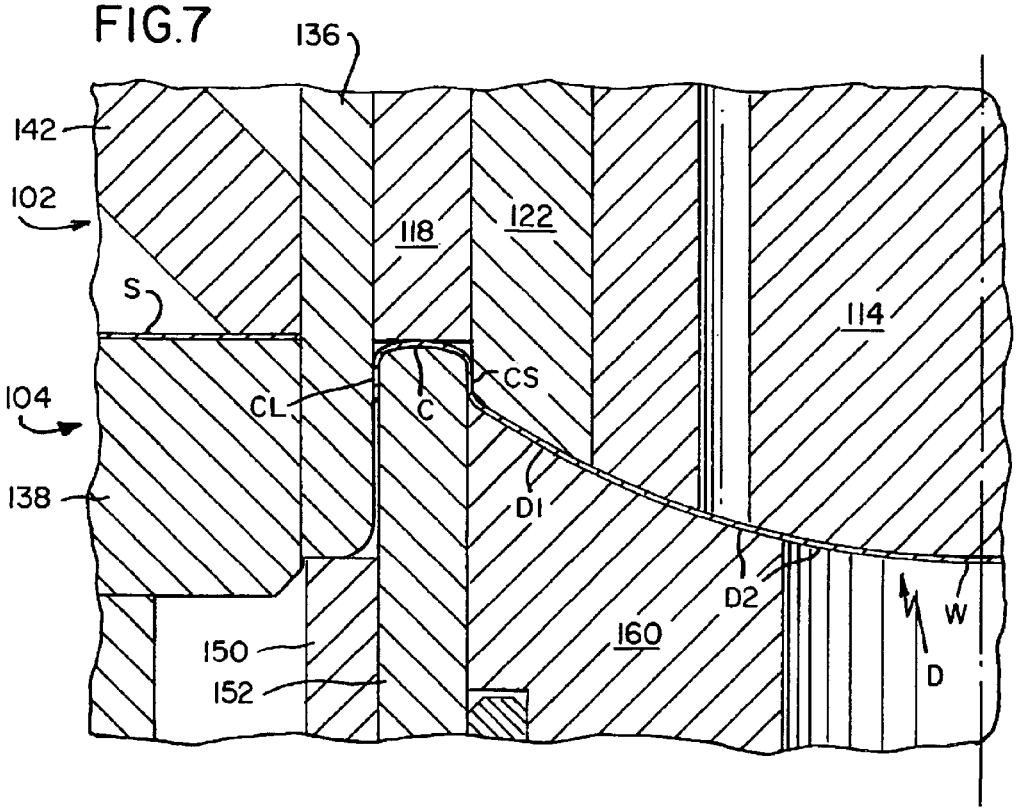
FIG. 7 is an enlarged, partially sectioned front view showing portions of the press of FIG. 1 wherein the lower dome form die collapses to form a countersink while material flow is controlled by the knockout and the crown ring thus finishing the crown geometry with the outer crown lip being finished to its final length.

In FIG. 7, with the dome D substantially completely formed, the redraw sleeve 122 bottoms on the upper retainer 116 thereby collapsing the dome form die 160 against the force provided by the pressure pins 162. The collapse of the dome form die 160 forms a countersink CS thereby completing the formation of the crown C for the domed aerosol can end formed from the workpiece W.

After formation, the domed aerosol can end is retained within the upper punch assembly 102 and is transported upward therewith. The knockout 118 pushes the domed aerosol can end out of the upper punch assembly 102 with the domed aerosol can end being ejected and carried away. This portion of the processing of the can end is in accordance with known, commercially available handling equipment and, accordingly, will not be described further herein.

Having thus described the invention of the present application in detail and by reference to currently preferred embodiments thereof, it will be apparent that modifications and variations are possible without departing from the scope of the invention defined in the appended claims.

What is claimed is:

1. A method for forming a domed aerosol can end from a sheet of material in a press having a fixed base and a movable punch assembly, said method comprising the steps of:

blanking a workpiece from said sheet of material;

holding said workpiece between a blank punch carried by said punch assembly and a draw pad carried by said base;

holding said workplace between a knockout carried by said punch assembly and a crown ring carried by said base;

advancing said blank punch and said draw pad to form an outer crown lip around the periphery of said workpiece;

advancing an outer redraw sleeve, carried by said punch assembly, to form an outer portion of a dome of said domed aerosol can end between said redraw sleeve and a dome form die on said base, said knockout and said crown ring holding said workpiece to control the flow of material into said outer portion of said dome;

advancing a dome punch to form an inner portion of said dome with said dome form die, said knockout and said crown ring holding said workplace to control the flow of material into said inner portion of said dome, said outer crown lip shortening in accordance with said flow of material; and collapsing said dome form die to form a crown for said domed aerosol can end.

2. A method for forming a domed aerosol can end as claimed in claim 1 further comprising the step of holding said outer portion of said dome between said redraw sleeve and said dome form die to control the flow of material into said inner portion of said dome as said dome punch advances to form said inner portion of said dome.

3. A method for forming a domed aerosol can end as claimed in claim 1 wherein said steps of advancing an outer redraw sleeve and advancing a dome punch are performed to substantially completely form said outer portion of said dome before said dome punch contacts said workpiece.

4. A method of forming a domed aerosol can end from a sheet of material in a press having a fixed base and a movable punch assembly, said method comprising the steps of:

blanking a workpiece from said sheet of material;

holding said workpiece between a blank punch carried by said punch assembly and a draw pad carried by said base;

holding said workpiece between a knockout carried by said punch assembly and a crown ring carried by said base;

advancing said blank punch and said draw pad to form an outer crown lip around the periphery of said workpiece;

advancing an outer redraw sleeve and a dome punch, both carried by said punch assembly, to form an outer portion of said dome of said domed aerosol can end between said outer redraw sleeve and a dome form die; and advancing said dome punch to form an inner portion of said dome with said dome form die, said knockout and said crown ring holding said workplace to control the flow of material into said inner portion of said dome, said outer crown lip shortening in accordance with said flow of material.

5. A method of forming a domed aerosol can end as claimed in claim 4 further comprising the step of forming a crown of said domed aerosol can end.

6. A method of forming a domed aerosol can end as claimed in claim 5 wherein said step of forming a crown of said domed aerosol can end comprises the step of collapsing said dome form die.

7. A method for forming a domed aerosol can end as claimed in claim 5 wherein said step of forming a dome of said domed aerosol can end further comprises the step of holding said outer portion of said dome between said outer redraw sleeve and said dome form die to control the flow of material into said inner portion of said dome as said dome punch advances to form said inner portion of said dome.

8. A method of forming a domed aerosol can end as claimed in claim 7 wherein said step of forming a crown of said domed aerosol can end comprises the step of collapsing said dome form die.

9. A method for forming a dome of a domed aerosol can end from a workpiece blanked from a sheet of material in a press having a fixed base and a movable punch assembly, said method comprising the steps of:

holding said workplace between a knockout carried by said punch assembly and a crown ring carried by said base;

advancing an outer redraw sleeve and a dome punch, both carried by said punch assembly, to form an outer portion of said dome of said domed aerosol can end between said outer redraw sleeve and a dome form die; and advancing said dome punch to form an inner portion of said dome with said dome form die, said knockout and said crown ring holding said workpiece to control the flow of material into said inner portion of said dome.

10. A method for forming a dome of a domed aerosol can end as claimed in claim 9 further comprising the step of holding said outer portion of said dome between said outer redraw sleeve and said dome form die to control the flow of material into said inner portion of said dome as said dome punch advances to form said inner portion of said dome.

* * * * *

UNITED STATES PATENT AND TRADEMARK OFFICE

CERTIFICATE OF CORRECTION

PATENT NO. : 6,830,419 B1 
DATED : December 14, 2004
INVENTOR(S) : Stephen B. Turner and Carl W. Hoying It is certified that error appears in the above-identified patent and that said Letters Patent is hereby corrected as shown below:

Column 6,
Line 26, "holding said workplace" should read -- holding said workpiece --;

Column 7,
Line 10, "holding said workplace" should read -- holding said workpiece --;

Column 8,
Line 9, "holding said workplace" should read -- holding said workpiece --.

Signed and Sealed this

Twenty-eighth Day of June, 2005

JON W. DUDAS
*Director of the United States Patent and Trademark Office*